US005297609A

United States Patent [19]

Cook

[11] Patent Number: 5,297,609

[45] Date of Patent: * Mar. 29, 1994

[54] INVESTMENT CASTING OF METAL MATRIX COMPOSITES

[75] Inventor: Arnold J. Cook, 372 N. Craig St., Pittsburgh, Pa. 15213

[73] Assignee: Arnold J. Cook, Pittsburgh, Pa.

[ * ] Notice: The portion of the term of this patent subsequent to May 19, 2009 has been disclaimed.

[21] Appl. No.: 883,661

[22] Filed: May 15, 1992

Related U.S. Application Data

[63] Continuation of Ser. No. 594,303, Oct. 9, 1990, Pat. No. 5,113,925.

[51] Int. Cl.[5] ..... B22C 9/02; B22D 19/02; B22D 19/14

[52] U.S. Cl. ..... 164/35; 164/97; 164/98

[58] Field of Search ..... 164/34, 35, 36, 97, 164/98, 45, 516

[56] References Cited

U.S. PATENT DOCUMENTS

| | | | |
|---|---|---|---|
| 4,109,699 | 8/1978 | Miller et al. | 164/35 |
| 4,365,997 | 12/1982 | Jachowski et al. | 164/97 |
| 4,476,916 | 10/1984 | Nusbaum | 164/97 |

FOREIGN PATENT DOCUMENTS

| | | | |
|---|---|---|---|
| 58-29564 | 2/1983 | Japan | 164/97 |
| 554930 | 5/1977 | U.S.S.R. | 164/45 |
| 996063 | 2/1983 | U.S.S.R. | 164/97 |

*Primary Examiner*—Kuang Y. Lin
*Attorney, Agent, or Firm*—Ansel M. Schwartz

[57] ABSTRACT

A method for forming a metal matrix composite within a mold of investment material. The method comprises the steps of forming a preform mixture of liquid flow medium, binding agent and reinforcement into the desired shape of a metal matrix composite. Then, allowing the preform mixture to solidify into desired shape. Next, encasing the preform mixture within a container of investment material. Then, heating the preform mixture at a controlled rate which first allows any fluid, such as water, to evaporate, then allows removal of the flow medium. Next, sintering the remaining reinforcement material and binder to form a solid preform. Then, disposing molten metal on top of the solid preform within the container such that the molten metal forms a seal with the container. Next, pressurizing the molten metal such that it is forced into said preform. Next, solidifying the molten metal to form a metal matrix composite in the shape of this preform; and removing the investment material from metal matrix composite. Additionally, there is a method comprising the steps of connecting a preform, which has been previously prepared for infiltration of molten material and having a binding agent, to a sprue system. Next, encasing the preform and sprue system within a container of investment material. Then, melting out the sprue system to form piping which allows the metal to flow to the preform. Next, sintering said preform with said binding agent therein to form a solid preform. Then, disposing molten metal on top of the preform within the container such that molten metal form a seal with the container. Next, pressurizing the molten metal such that it is found through the sprue system and into the preform. Then, solidifying the molten metal to form a metal matrix composite in the shape of the preform; and removing the investment material from metal matrix composite.

20 Claims, 3 Drawing Sheets

INVESTMENT CASTING OF METAL MATRIX COMPOSITES

This is a continuation of copending application Ser. No. 07/594,303 filed on Oct. 9, 1990, now U.S. Pat. No. 5,113,925.

FIELD OF THE INVENTION

The present invention is related to an apparatus for casting. More specifically, the present invention is related to a method for casting metal matrix composites within investment material.

BACKGROUND OF THE INVENTION

Investment casting, also known as the lost wax method, is one of the oldest processes for the forming of metal. It was used extensively by the ancient craftsman, to form jewelry and is currently the preferred method for casting complex parts for aircraft engines. Patterns are typically formed by pressure injection of wax or plastic into a precision metal die. Patterns, either singly or in groups, are fitted with wax gates and risers and encased in an investment material such as a slurry of refractory material. The wax or plastic patterns are then melted out of the investment material thereby leaving molds of the parts to be cast connected by a series of gates and risers. The preferred molten metal is then caused to fill the hollow impressions through the piping of the gates and risers. After solidification, the investment material is removed from the metal parts.

In the past, metal matrix composites have been investment casted by first mixing the metal with the reinforcement and then introducing the molten mixture to the mold. There is no known method that allows the infiltration of the reinforcement material within a mold of investment material.

SUMMARY OF THE INVENTION

The present invention pertains to a method for forming a metal matrix composite within a mold of investment material. The method comprises the steps of forming a preform mixture of liquid flow medium, binding agent and reinforcement into the desired shape of a metal matrix composite. Then, allowing the preform mixture to solidify into desired shape. Next, encasing the preform mixture within a container of investment material. Then, heating the preform mixture at a controlled rate which first allows any fluid, such as water, to evaporate, then allows removal of the flow medium. Next, sintering the remaining reinforcement material and binder to form a solid preform. Then, disposing molten metal on top of the solid preform within the container such that the molten metal forms a seal with the container. Next, pressurizing the molten metal such that it is forced into said preform. Next, solidifying the molten metal to form a metal matrix composite in the shape of this preform; and removing the investment material from metal matrix composite.

Additionally, there is a method comprising the steps of connecting a preform, which has been previously prepared for infiltration of molten material and having a binding agent, to a sprue system. Next, encasing the preform and sprue system within a container of investment material. Then, melting out the sprue system to form piping which allows the metal to flow to the preform. Next, sintering said preform with said binding agent therein to form a solid preform. Then, disposing molten metal on top of the preform within the container such that molten metal form a seal with the container. Next, pressurizing the molten metal such that it is found through the sprue system and into the preform. Then, solidifying the molten metal to form a metal matrix composite in the shape of the preform; and removing the investment material from metal matrix composite.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
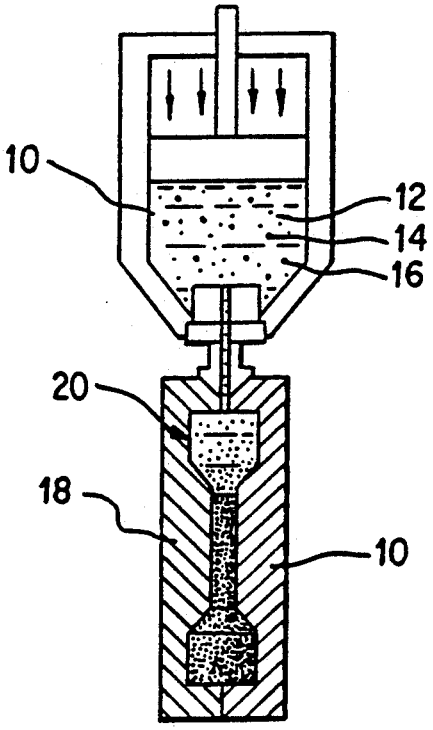
FIG. 1 is a cross-sectional schematic view showing the casting of the preform mixture.

Referring now to the drawings wherein like reference numerals refer to similar or identical parts throughout the several views, and more specifically to FIG. 1 thereof, there is shown a cross sectional schematic view of a preform mixture 10 in a liquid form. The mixture 10 is comprised of a flow medium 12, such as wax or water, discontinuous reinforcement material 14, such as SiC particulate, and reinforcement binder 16, for example, silica (represented in the figures by dots). The preform mixture 10 is forced into a preform mold 18. In another embodiment, continuous reinforcement 20 such as wrapped fiber, such as graphite (represented on the figures by hatching), is placed within the preform mold 18 prior to introduction of the flow medium 12 and reinforcement binder 16.

Figure 2:
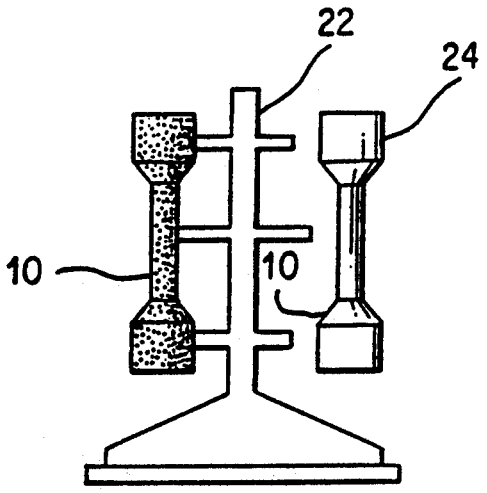
FIG. 2 is a cross-sectional schematic view showing the connection of the cast preform mixtures to the sprue system.

The preform mixture 10 is then solidified and removed from the preform mold 18. As best shown in FIG. 2, a plurality of solidified preform mixture 10 are fixedly attached to a wax or plastic sprue system 22. A single solidified preform mixture 10 can be attached to sprue system 20, but it is typically more economical to cast a plurality of parts through a common sprue system 20. Next, a mold coating 24, such as silicate glass, is applied to the solidified preform mixtures 10 and sprue system by dipping or spraying. This mold coating 24 is comprised of materials which help to form a seal around the solidified preform mixture 10 and aid in removal of the parts from the mold.

Figure 3:
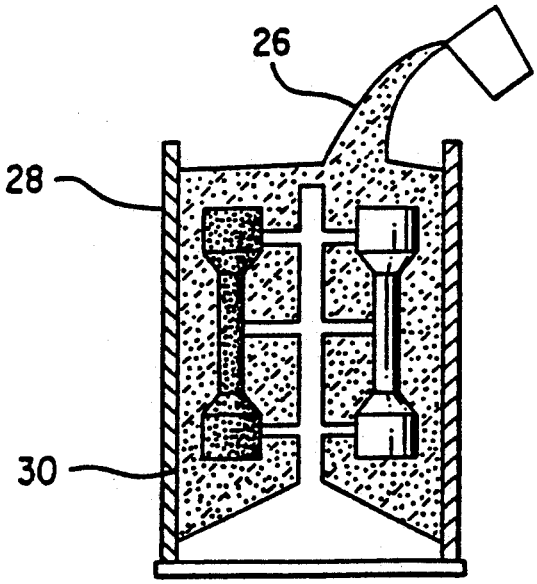
FIG. 3 is a cross-sectional schematic view showing the encasement of the cast preform mixtures within investment material.

FIG. 3 shows the step of encasing the sprue system 22 with attached solidified preform mixtures 10 within investment material 26 which is disposed in a can mold 28 coated with mold release 30. In another preferred embodiment, the sprue system 22 with attached solidified preform mixtures 10 is coated with a slurry of investment material 26 which is comprised of refractory material such as ceramic.

Figure 4:
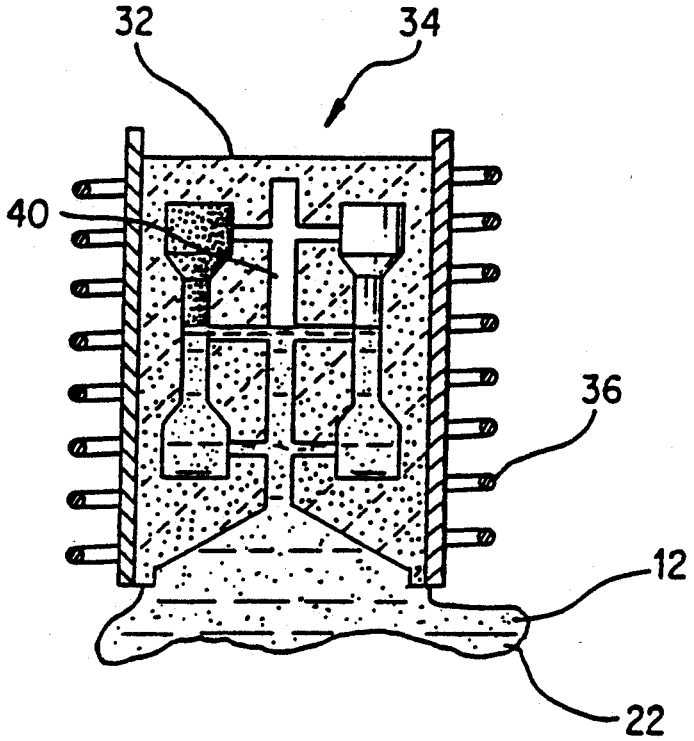
FIG. 4 is a cross-sectional schematic view showing the removal of the flow medium and sprue system material by heating.
Figure 5:
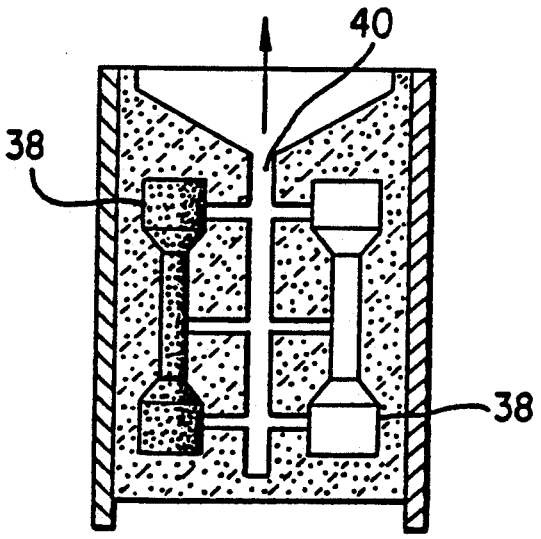
FIG. 5 is a cross-sectional schematic view showing the evacuation of gas from the sprue system and preforms.
Figure 6:
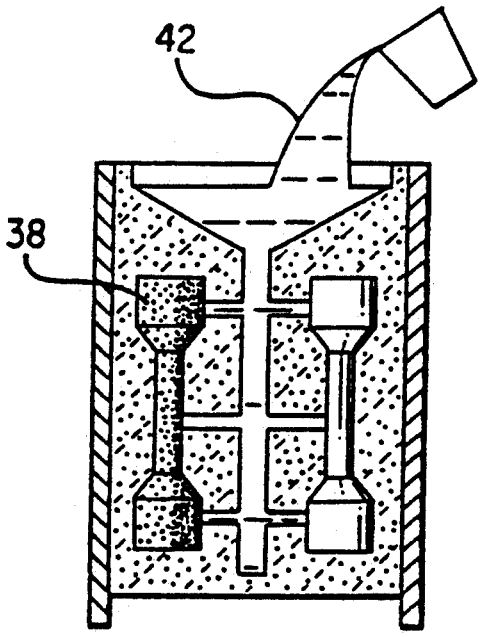
FIG. 6 is a cross-sectional schematic view showing the metal being poured into the sprue system.
Figure 7:
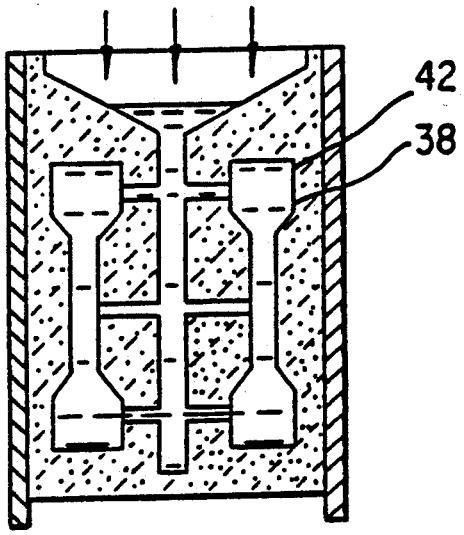
FIG. 7 is a cross-sectional schematic view showing the pressurization step which forces the molten metal into the preforms.
Figure 8:
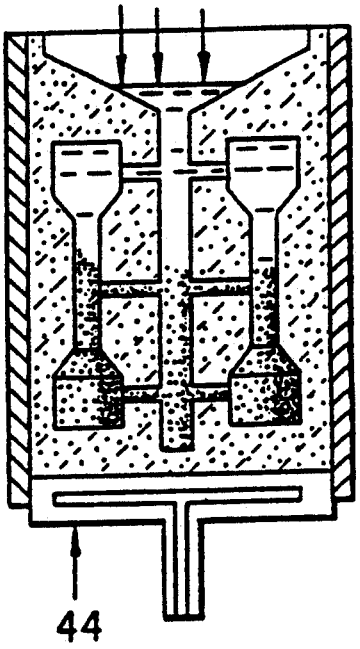
FIG. 8 is a cross-sectional schematic view showing directional solidification of the cast metal matrix composite parts by a chill plate.
Figure 9:
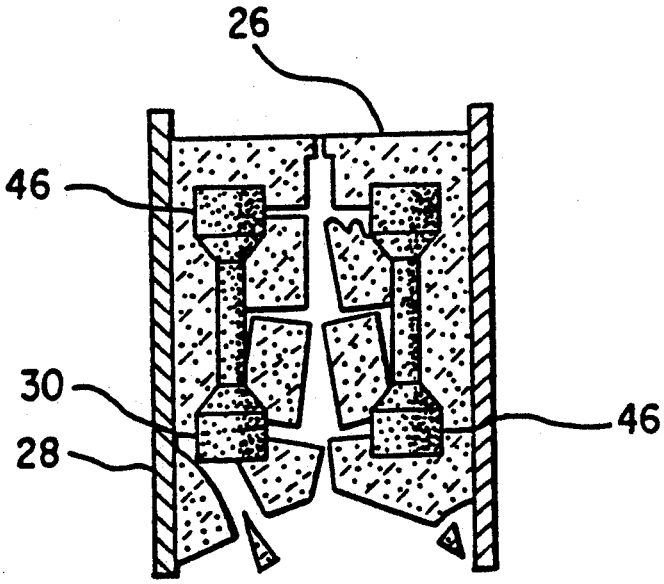
FIG. 9 is a cross-sectional schematic view showing removal of the investment material from the metal matrix composite parts.

Next, as shown in FIG. 4, the mold assembly 34 which is comprised of sprue system 22, solidified preform mixtures 10 and investment material 26 is heated at a controlled rate by heater 36. It is heated such that, first any fluid, for example, water is slowly evaporated from the mold assembly 34, then flow material 12 and the wax or plastic of sprue system 22 is melted out. Finally, the investment material 26, reinforcement binder 16 and discontinuous reinforcement material 14 (or continuous reinforcement material 20) is sintered. This process yields a plurality of preforms 38 connected by the piping 40 left behind by the melted sprue system 22; all encased within investment material 26. As shown in FIG. 5, the preforms 38 and piping 40 are evacuated to remove any gas. Next, as shown in FIG. 6, molten metal 42 is poured or injected into the sprue system 22. The molten metal 42 is then forced by pressure through the piping 40 into the interstices of the preforms 38 as shown in FIG. 7. Coating 24 prevents the metal from infiltrating into the investment 26. If the alternate embodiment of a coated slurry of investment material 26 is used, then a coating 24 is obviously not necessary. A chill plate 44 can then be used to directionally solidify the metal 42, while the pressure is still being applied. This allows for excess molten metal 42 to fill the voids of preforms 38 as the metal 42 solidifies and contracts. The investment material 26 is finally removed from the resulting metal matrix composite parts 46.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for forming a metal matrix composite within a mold of investment material comprising the steps of:

forming a preform mixture of liquid flow medium, binding agent and reinforcement material into the desired shape of said metal matrix composite;

allowing the preform mixture to solidify into said desired shape;

encasing the preform mixture within a container of investment material;

heating said preform mixture such that any water evaporates and the flow medium is removed;

sintering the remaining reinforcement material and binder agent to form a solid preform;

disposing molten metal on top of the solid preform within the container such that the molten metal forms a seal with the container;

pressurizing the molten metal such that it is forced into said preform;

solidifying said molten metal to form said metal matrix composite in the shape of said preform; and removing said investment material from the metal matrix composite.

2. A method as described in claim 1 including before the encasing step, the step of attaching a plurality of preform mixtures to a sprue system for the function of casting a plurality of metal matrix composites during the same process.

3. A method as described in claim 1 wherein the encasing step includes the step of coating the solidified preform mixture to form the container.

4. A method as described in claim 3 wherein the step of coating includes the step of coating the solidified preform mixture with a slurry of investment material to form the container.

5. A method as described in claim 4 wherein the slurry of investment material is refractory material.

6. A method as described in claim 5 wherein the refractory material is ceramic.

7. A method as described in claim 2 wherein the encasing step includes the step of coating the solidified preform mixture to form the container.

8. A method as described in claim 7 wherein the step of coating includes the step of coating the solidified preform mixture with a slurry of investment material to form the container.

9. A method as described in claim 8 wherein the slurry of investment material is refractory material.

10. A method as described in claim 9 wherein the refractory material is ceramic.

11. A method for forming a metal matrix composite within a mold of investment material comprising the steps of:

connecting a preform, which was previously prepared for infiltration of molten material and having a binding agent, to a sprue system;

encasing the preform and sprue system within a non-porous container of investment material;

melting out said sprue system to form piping which allows metal to flow to said preform;

sintering said preform with said binding agent therein to form a solid preform;

disposing molten metal on top of the preform within the container such that the molten metal forms a seal with the container;

pressurizing the molten metal such that it is forced through said piping and into said solid preform;

solidifying said molten metal to form a metal matrix composite in the shape of said solid preform; and removing said investment material from metal matrix composite.

12. A method as described in claim 11 wherein the encasing step includes the step of coating the solidified preform mixture to form the container.

13. A method as described in claim 12 wherein the step of coating includes the step of coating the solidified preform mixture with a slurry of investment material to form the container.

14. A method as described in claim 13 wherein the slurry of investment material is refractory material.

15. A method as described in claim 14 wherein the refractory material is ceramic.

16. A method as described in claim 11 including before the encasing step, the step of attaching a plurality of preforms to a sprue system for the function of casting a plurality of metal matrix composites during the same process.

17. A method as described in claim 16 wherein the encasing step includes the step of coating the solidified preform mixture to form the container.

18. A method as described in claim 17 wherein the step of coating includes the step of coating the solidified preform mixture with a slurry of investment material to form the container.

19. A method as described in claim 18 wherein the slurry of investment material is refractory material.

20. A method as described in claim 19 wherein the refractory material is ceramic.

* * * * *